United States Patent [19]

Lydall

[11] 4,034,505

[45] July 12, 1977

[54] TREE STAND

[76] Inventor: Michael L. Lydall, Rte. 2, Box 44 A-8, Philomath, Oreg. 97370

[21] Appl. No.: 643,031

[22] Filed: Dec. 22, 1975

[51] Int. Cl.[2] ..... A47G 7/00

[52] U.S. Cl. ..... 47/40.5; 248/527

[58] Field of Search ..... 248/521–529, 248/527; 47/39, 405, 41.13, 40.5

[56] References Cited

U.S. PATENT DOCUMENTS

| | | | |
|---|---|---|---|
| 1,155,383 | 10/1915 | Tischer | 248/524 |
| 1,846,891 | 2/1932 | Miller | 47/40.5 |
| 1,873,693 | 8/1932 | Whitfield et al. | 248/524 |
| 2,029,281 | 1/1936 | McCann | 248/524 |
| 2,419,183 | 4/1947 | Womack | 248/524 |
| 2,441,473 | 5/1948 | Davis | 24 8/529 |
| 2,639,877 | 5/1953 | Fox | 47/40.5 |
| 2,679,994 | 6/1954 | Mellen | 47/40.5 |
| 2,686,989 | 8/1954 | Dillon et al. | 47/41.13 |
| 2,879,019 | 3/1959 | Fox | 47/40.5 |
| 2,896,293 | 7/1959 | Love | 248/523 |
| 2,913,202 | 11/1959 | Meldrum | 47/40.5 |
| 3,038,689 | 6/1962 | Matson | 47/40.5 |
| 3,298,643 | 1/1967 | Taylor | 47/40.5 |
| 3,784,136 | 1/1974 | Lopez | 47/40.5 |
| 3,815,854 | 6/1974 | Zipser | 47/40.5 |

*Primary Examiner*—Edgar S. Burr
*Assistant Examiner*—James R. Feyrer
*Attorney, Agent, or Firm*—Kolisch, Hartwell, Dickinson & Stuart

[57] ABSTRACT

A stand for an elongate upright object, such as a tree, including a fluid-holding receptacle into which the butt, or base, end of the object may be received, with a restraining device for engaging and holding the butt of the object against lateral movement in the receptacle. A cover for the receptacle has an opening extending therethrough to receive a portion of the object with screw adjustable engaging members mounted on one side of the opening. An elongate serrated wedge is slidably mounted on the top of the cover opposite the engaging members. The wedge may be slid into position frictionally engaging the object to hold it in place against the engaging members. Another opening in the cover is so positioned and of such size as to receive a support for the wedge on another cover to accommodate nested stacking of a plurality of the covers. A fluid barrier is removably mounted in the receptacle to prevent fluid in the receptacle from contacting the base of the object if desired.

7 Claims, 5 Drawing Figures

TREE STAND

BACKGROUND AND SUMMARY OF THE INVENTION

This invention pertains to a stand for an elongate, upright object such as a tree, and more particularly to such a stand which utilizes a wedge to clamp the tree tightly in a holding position, and has a fluid barrier removably mounted therein for preventing fluid held within the container from contacting the base, or butt, end of the object if desired.

In the past, various devices for supporting objects such as trees have been devised, but they have not been altogether satisfactory. Although wedge-type clamping devices may have been used, they have not provided the desired adjustability to accommodate trees having a curve in that portion of the trunk below the wedge which is held by restraining means below the wedge. Explaining further, with previous devices, when a tree has been inserted therein and then clamped into position by a sliding wedge, there has been no means for taking care of the curvature of the tree to insure that the portion of the tree above the wedge will stand upright. With no selective adjustment of engaging members in such devices, the tree must either be left at an incline or removed and reset several times to achieve the desired upright position for the tree.

It has been found also that while a fluid ballast, such as water, in the base is desirable for holding a tree, or like object, in an upright position, it is not always desirable to have the fluid within the base in contact with the tree. While it is desirable to provide water for the tree while in warm or temperate climates the opposite may be true in subfreezing areas. If the tree is supported out of doors, as on a tree lot in subfreezing weather, the fluid within the base used for ballast which comes into contact with the tree may freeze the tree into the base and thus prevents its removal from the base. This would be a decided disadvantage to operation of tree lots in such areas.

A general object of the present invention is to provide a novel stand which overcomes the disadvantages of previously designed stands as set out above in a simple and economic manner.

More specifically, an object of the invention is to provide a novel stand for an upright, elongate object, such as a tree, wherein the stand includes restraining means in the base for holding the butt end of the object against lateral movement, adjustable engaging means spaced above the butt of the tree selectively adjustable to engage side portions of the tree, and a sliding serrated wedge mounted opposite the engaging means for shifting movement between an engaging position frictionally wedging the tree against the engaging members and a release position permitting removal of the tree.

Yet another object is to provide such a novel stand wherein the base includes a fluid-holding receptacle for receiving the base, or butt, end of the object and further includes a fluidtight barrier surrounding the butt end of the object to prevent fluid held in the receptacle from contacting the object.

A still further object of the invention is to provide such a barrier which is removably mounted in the receptacle permitting use of the barrier to prevent fluid contact or removal of the barrier to permit fluid contact when desired.

Yet another object of the invention is to provide such a novel stand having a cover in which a support for the sliding wedge projects upwardly from the top of the cover and wherein the cover includes an opening of sufficient size to receive such a support to permit nested stacking of a plurality of such covers, with the support on one of the covers extending through the described opening in another cover.

DRAWINGS

These and other objects and advantages will become more fully apparent as the following description is read in conjunction with the drawings wherein.

DETAILED DESCRIPTION OF A PREFERRED EMBODIMENT OF THE INVENTION

Figure 1:
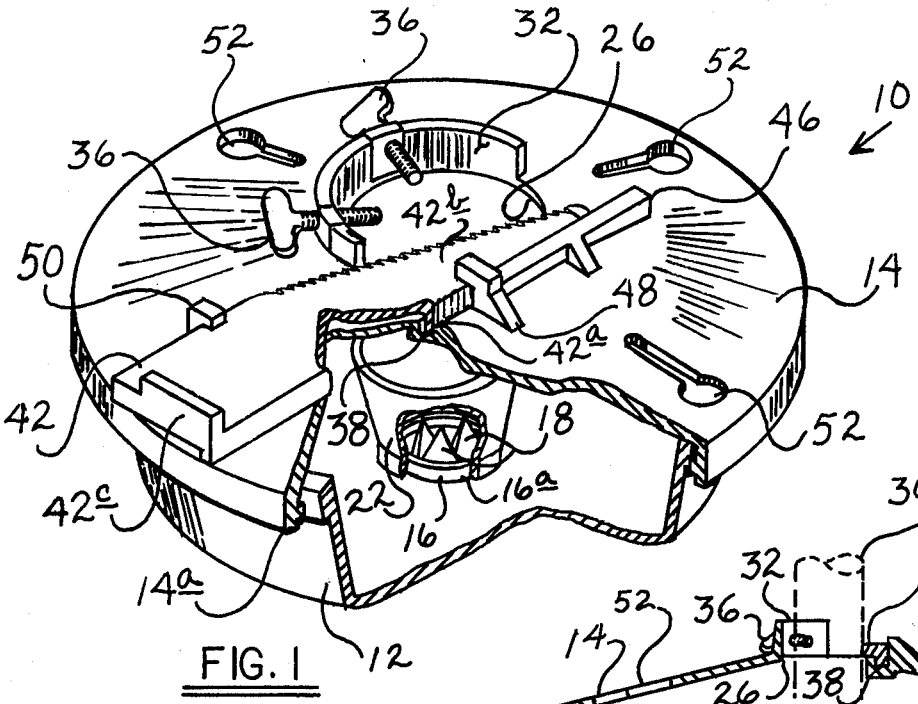
FIG. 1 is a perspective view of a stand constructed according to an embodiment of the invention with a top and side portion thereof broken away.

Referring to the drawings, and first more specifically to FIG. 1, at 10 is indicated generally a stand constructed according to an embodiment of the invention. The stand includes generally a fluid-holding receptacle, or base, 12 and a cover 14 which rests removably atop the base. The base and cover both may be formed of a plastic material.

Describing base 12, it includes a floor, or bottom, **12*a* with a substantially cylindrical side wall 12*b*** formed integrally therewith and projecting upwardly therefrom.

A thicker, circular portion 16 having an upstanding ring-like edge **16*a* projecting upwardly therefrom, is positioned centrally of the floor of the base. Secured centrally within ring 16*a* is a rigid spike device having a plurality of upstanding wedge-shaped spikes, or restraining means, 18**.

A hollow cylindrical fluid barrier 22 is illustrated with its base surrounding portion 16 of the base. The lower portion of barrier 22 is constructed to fit slidably and snuggly about ring edge **16*a* to provide a fluidtight connection therebetween. To accomplish this, the inner side surfaces of the lower portion of barrier 22 may converge slightly on progressing upwardly from the lower edge of the barrier whereby the barrier tightens on ring edge 16*a* as it is forced downwardly thereon. As is seen, the barrier has a height which is at least as great as the depth of base 12**.

Referring to cover 14, it has the shape of an inverted saucer, with the upper surface thereof sloping downwardly on progressing radially outwardly from the center and toward the outer edges of the cover. The outer edge of the cover has a depending lip **14*a* which surrounds the upper marginal edge of side wall 12*b* of the base to maintain the cover in position against lateral forces which may be exerted on the cover when it is in its operating position as illustrated. A circular opening 26 is formed centrally in cover 14 to provide an opening through which a tree or other elongate object to be held in the stand may extend. A portion of the trunk of a tree is illustrated at 30 in solid line in FIG. 2 and in dot-dashed outline in FIG. 3. As is seen in FIG. 3, when the tree is held in the stand, its butt, or base, end is impaled on spikes 18** and thus is restrained against lateral movement relative to the stand.

An upstanding, semi-circular collar 32 is secured to and extends upwardly from cover 14 adjacent opening 26. A pair of angularly disposed, elongate thumb screws 36 extend through threaded bores in collar 32. These screws are adjustable into and out of the region of opening 26 to engage spaced-apart side portions of tree 30 as desired.

Figure 3:
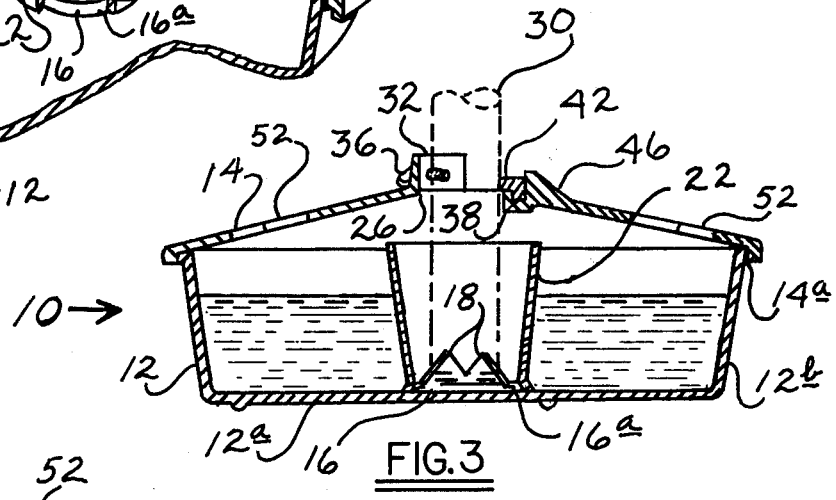
FIG. 3 is a cross-sectional view taken generally along the line 3—3 in FIG. 2.
Figure 2:
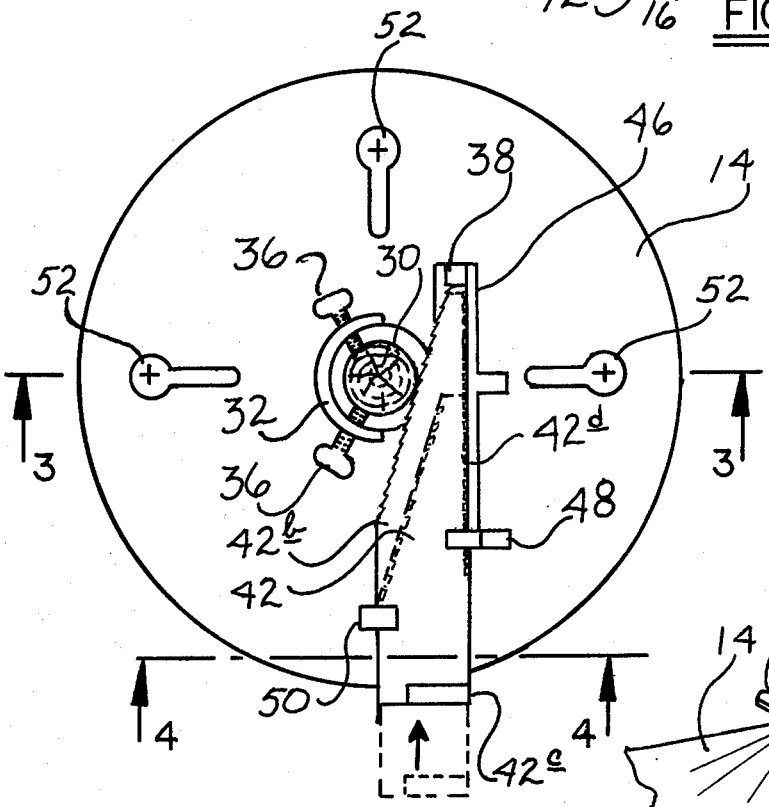
FIG. 2 is a top plan view of the stand.
Figure 4:
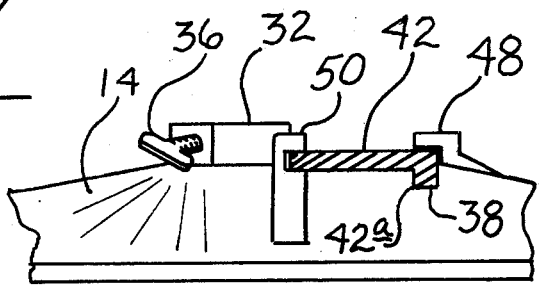
FIG. 4 is an enlarged cross-sectional view taken generally along the line 4—4 in FIG. 2.

As is best seen in FIGS. 2, 3, and 4, an elongate channel 38 formed in the top of cover 14 extends parallel to a line extending tangentially of opening 26 on the side of the opening opposite thumb screws 36.

An elongate wedge 42 is slidably mounted atop the cover. The wedge has an elongate lip **42*a* formed thereon extending along and depending from one side of the wedge. Lip 42*a* is slidably received in channel 38.**

Wedge 42 also has an elongate serrated wedging edge **42*b* which faces generally in the direction of thumb screws 36 and on progressing in one direction converges toward the side of the wedge bearing lip 42*a*. An upstanding lug 42*c* is provided adjacent the rear end of wedge 42 to provide a section which may be gripped with the hand or kicked with the foot to slide the wedge in channel 38. The wedge is shiftable in channel 38 between an engaging position as illustrated in solid outline in FIG. 2, with edge 42*b* frictionally engaging a side of tree 30 opposite engaging screws 36, and a release position retracted therefrom as illustrated in dot-dashed outline in FIG. 2. The elongate edge 42*d* of wedge 42 opposite edge 42*b*** has a plurality of indentations formed therein spaced apart longitudinally of the wedge.

Figure 5:
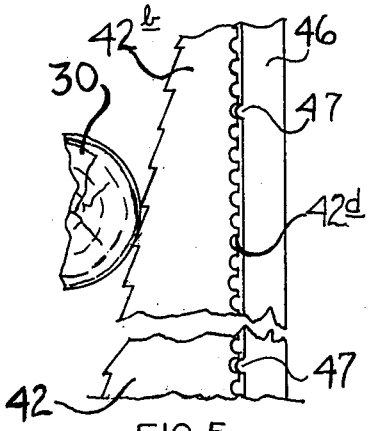
FIG. 5 is a partial plan view showing the wedging and locking action of the wedge member.

An elongate substantially horizontal guide 46 secured to cover 14 extends along one side of channel 38 to further guide wedge 42 in its sliding movement and to aid in holding the same against shifting laterally of the channel when placed in operative wedging position. At least a pair of rounded projections 47 extend outwardly from guide 46 to be received in indentations **42*d* in wedge 42. These projections aid in holding the wedge in a holding position as illustrated in solid outline in FIGS. 2 and 5** to support a tree or similar object therein.

A pair of support guides 48, 50 project upwardly from the top of cover 14 and have portions which overlie edge margins of wedge 42 to prevent the same from lifting from cover 14 as it slides in channel 38. As is best seen in FIGS. 1 and 2, support guide 50 is spaced a preselected distance from cover 14.

A plurality of keyhole-shaped fluid fill holes 52 are formed in cover 14 also. The wider portions of holes 52 are spaced outwardly from the center of cover 14 a distance substantially equal to the positioning of support guide 50. In operating position, holes 52 provide access for pouring water, or other desired, liquid into base 12. When a plurality of covers 12 are to be stacked in nesting relationship with wedges 42 removed therefrom, holes 52 provide openings through which a support guide 50 on an underlying cover may extend to permit compact nested stacking of the covers.

The diverging side walls of base 12 facilitate nested stacking of bases, and the diverging side walls of barrier 22 permit nested stacking of a plurality of the barriers.

In operation, one person may set up a tree, or other object, in a substantially upright position by himself. To do this, it is a simple matter to insert the base of the tree through opening 26 and impale it on spikes 18, If necessary screws 36 may be adjusted against side portions of the tree to place it in an upright position. Once these screws have been properly adjusted, it is a simple matter to forcefully shift the wedge to its holding position as illustrated in FIG. 2 frictionally to wedge the tree against screws 36 and hold the same therein with the serrations on the wedge and projections 47 received in identations **42*d* holding the wedge in place. To remove a tree therefrom it is a simple matter merely to retract the wedge to the position illustrated in dot-dashed outline in FIG. 2** to remove the tree. Once the tree is held in the base, water or other fluid may be poured into the base to provide ballast for the same.

Should it be desired to prevent fluid in the base from coming into contact with the base of the tree it is a simple matter to connect barrier 22 to ring **16*a*** to provide a fluidtight connection therebetween prior to inserting the tree in the stand. With the barrier in place, fluid in the base is prevented from contacting the tree.

Should it be desired to permit water or other fluid in the base to contact the tree, it is a simple matter to remove the barrier merely by slipping the same off ring **16*a*** when the tree is out of the base.

If there is not too great a difference in the diameter of trees being inserted and removed from the holder, as on a tree lot, there may be no need to adjust the thumb screws for each tree. But they are available for adjusting to a variety of tree sizes and to adjust for trees with curved trunks. The wedge provides simple, quick and effective clamping and release of the tree.

While a preferred embodiment of the invention has been described herein, it should be apparent to those skilled in the art that variations and modifications are possible without departing from the spirit of the invention.

What is claimed and desired to secure by letters patent is:

1. A stand for an elongate, upright object such as a tree comprising a base including a fluid holding receptacle for receiving the butt end of the object, restraining means for engaging and restraining the butt end of the object against lateral movement relative to said base, and holding means attached to said base above said restraining means having an opening extending vertically therethrough for receiving a portion of said object above its butt end, said holding means including at least a pair of spaced apart screw-adjustable engaging means disposed in a substantially common horizontal plane on one side of and adjacent said opening and mounted for adjustable movement independently of each other into and away from said opening, an elongate wedge having an elongate, serrated, inclined engaging edge, and means mounting said wedge along the side of the opening opposite said engaging means in a substantially horizontal position for movement in a substantially horizontal plane paralleling and closely adjacent the plane of said engaging means, with movement of the wedge in one direction toward an engaging position causing said engaging edge thereof to progressively decrease the distance between said edge and said engaging means frictionally to grip and hold the object in said opening, and movement in the opposite direction toward a release position releasing the object.

2. The stand of claim 1, which further includes inhibiting means on said mounting means operable to engage said wedge when in a holding position to inhibit movement thereof toward its release position.

3. The stand of claim 1, which further comprises barrier means in said receptacle positioned to surround the butt of an object held in said receptacle to prevent fluid held in said receptacle from contacting the object.

4. The stand of claim 1, wherein said wedge has an elongate lip extending along and depending from an elongate horizontally disposed edge of the wedge opposite its said engaging edge, and said means mounting the wedge includes means defining an elongate channel slidably receiving said lip to guide the wedge on movement between engaging and release positions and to maintain said wedge against movement laterally of said channel.

5. The stand of claim 3, which further comprises mounting means for removably attaching said barrier means to said receptacle.

6. The stand of claim 5, wherein said barrier means comprises a hollow cylinder and said mounting means comprises a ring secured to the floor of said receptacle over which ring the base of said cylinder fits in fluid-tight relationship.

7. A stand for an elongate, upright object such as a tree, comprising a base, restraining means for engaging and restraining the butt end of the object against lateral movement relative to said base, and holding means attached to said base above said restraining means, said holding means comprising a removable cover for said base having an upper surface sloping downwardly on progressing radially outwardly from the center thereof and, having an opening extending vertically therethrough for receiving a portion of the object above its butt end, mounted for adjustable movement into or away from said opening to engage said portion of the object, an elongate wedge, and means mounting said wedge for movement along the side of the opening opposite said engaging means, with movement of the wedge in one direction toward an engaging position causing an elongate engaging edge thereof to progressively decrease the distance between said edge and said engaging means frictionally to grip and hold the object in said opening, and movement in the opposite direction toward a release position releasing the object, said mounting for the wedge including a support secured to and projecting upwardly from said cover and spaced a preselected distance from the center of said cover, said cover further including an opening extending therethrough of sufficient size to receive said support, with said opening being spaced from said support at substantially the same preselected distance from the center of the cover to permit a similar support on another cover to extend therethrough to accommodate nested stacking of a plurality of said covers.

* * * * *

UNITED STATES PATENT AND TRADEMARK OFFICE

CERTIFICATE OF CORRECTION

PATENT NO. : 4,034,505
DATED : July 12, 1977
INVENTOR(S) : Michael L. Lydall

It is certified that error appears in the above-identified patent and that said Letters Patent are hereby corrected as shown below:

In column 3, line 17, delete "side" and insert --edge-- therefor.

In column 4, line 2, after "18" delete "," and insert --.-- therefor.

In column 6, line 11, insert --means-- before "mounted".

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*